US006124830A

United States Patent [19]

Yuanzhu

[11] Patent Number: 6,124,830

[45] Date of Patent: Sep. 26, 2000

[54] PLANAR ANTENNA

[75] Inventor: Dou Yuanzhu, Fukushima-ken, Japan

[73] Assignee: Alps Electric Co., Ltd., Tokyo, Japan

[21] Appl. No.: 09/354,255

[22] Filed: Jul. 15, 1999

[30] Foreign Application Priority Data

Jul. 23, 1998 [JP] Japan ..... 10-207589

[51] Int. Cl.[7] ..... H01Q 3/02

[52] U.S. Cl. ..... 343/700 MS; 343/848

[58] Field of Search ..... 343/700 MS, 846, 343/848, 853, 777, 852, 851

[56] References Cited

U.S. PATENT DOCUMENTS

| | | | |
|---|---|---|---|
| 4,761,653 | 8/1988 | Owens et al. | 343/700 MS |
| 4,914,445 | 4/1990 | Shoemaker | 343/700 MS |
| 4,937,585 | 6/1990 | Shoemaker | 343/700 MS |
| 5,210,541 | 5/1993 | Hall et al. | 343/700 MS |
| 5,233,361 | 8/1993 | Boguais | 343/700 MS |

FOREIGN PATENT DOCUMENTS 6-132718 5/1994 Japan .

7-297630 11/1995 Japan .

*Primary Examiner*—Don Wong
*Assistant Examiner*—Ephrem Alemu
*Attorney, Agent, or Firm*—Brinks Hofer Gilson & Lione

[57] ABSTRACT

A fifth transmission line is connected between points at each of which a difference between a length from the point to one side of one antenna element in a first transmission line or a second transmission line and a length from the point to one side of the other antenna element is equal to the half of the wavelength. A sixth transmission line is connected between points at each of which a difference between a length from the point to one side of one antenna element in a third transmission line or a fourth transmission line and a length from the point to one side of the other antenna element is equal to the half of the wavelength. A voltage based on a vertically polarized wave is outputted from an intermediate point of the fifth transmission line and a voltage based on a horizontally polarized wave is outputted from an intermediate point of the sixth transmission line.

5 Claims, 3 Drawing Sheets

PLANAR ANTENNA

BACKGROUND OF THE INVENTION

1. Field of the Invention

The present invention relates to a planar antenna for receiving electric waves from a satellite for broadcasting or a satellite for communication. More particularly, the invention relates to a planar antenna suitable for receiving linearly polarized waves including vertical polarized waves and horizontal polarized waves.

2. Description of the Related Art

FIG. 4 is a top view of a conventional planar antenna, in which four antenna elements 32, 33, 34, and 35 for reception are arranged on the top face of a multilayer substrate 31 comprised of four conductive layers and three insulating layers. Each of the antenna elements 32, 33, 34, and 35 for reception is formed in a square shape by, for example, the conductive surface layer of the insulating substrate 31. The length of one side is set so as to be equal to about the half of the wavelength of a receiving wave. With the length, the resonance frequency of each of the antenna elements 32, 33, 34, and 35 coincides with the center frequency of the receiving wave.

The antenna elements 32, 33, 34, and 35 for reception are arranged in the vertical and lateral directions on the insulating substrate 31 in a state where one sides of neighboring elements face each other in parallel.

Between the facing two sides in the antenna elements 32, 33, 34, and 35 for reception, as illustrated in FIG. 4, a voltage Ev (hereinbelow, referred to as a vertical voltage) in the vertical direction based on vertically polarized waves and a voltage Eh (hereinbelow, called a horizontal voltage) in the lateral direction based on horizontally polarized waves are induced.

In order to separately take out the vertical voltage Ev and the horizontal voltage Eh induced by each of the antenna elements 32, 33, 34, and 35 for reception, an antenna element 36 for coupling is formed by a second conductive layer almost in the center of the antenna elements 32, 33, 34, and 35 for reception.

A part of the antenna element 36 for coupling and a part of each of the antenna elements 32, 33, 34, and 35 for reception are overlapped. In overlapped parts 37, 38, 39, and 40, the antenna element 36 for coupling is coupled to the antenna elements 32, 33, 34, and 35 for reception via a first insulating layer 31*a* of the multilayer substrate 31. As a result, the vertical voltages Ev and the horizontal voltages Eh induced by the antenna elements 32, 33, 34, and 35 for receptionare induced and synthesized by the antenna element 36 for coupling.

Transmission lines 41 and 42 coupled to the antenna element 36 for coupling, for separately taking out the vertical voltage Ev and the horizontal voltage Eh induced by the antenna element 36 for coupling are made by a third conductive layer so as to form an angle of 90 degrees. The transmission lines 41 and 42 are coupled to the antenna element 36 for coupling via a second insulating layer 31*b*. The transmission line 41 is provided in parallel to the direction of the induction of the horizontal voltage Eh. The transmission line 42 is provided in parallel to the direction of the induction of the vertical voltage Ev.

The horizontal voltage Eh is taken out from the transmission line 41 and the vertical voltage Ev is taken out from the transmission line 42.

Below the transmission lines 41 and 42, an earth conductive layer 31*d* as a lowermost layer is provided via a third insulating layer 31*c*.

Since the transmission lines 41 and 42 extend to the peripheral parts of the multilayer substrate 31, when terminals (not shown) connected to the transmission lines 41 and 42 are provided at ends of the multilayer substrate 31 by proper means, the horizontal voltage Eh and the vertical voltage Ev are easily taken out.

In the conventional planar antenna, however, the vertical and horizontal voltages induced by the antenna elements 32, 33, 34, and 35 are induced by the antenna element 36 for coupling via the insulating layer 31*a* and further connected from the antenna element 36 for coupling to the transmission lines 41 and 42 via the insulating layer 31*b*. There is, consequently, a problem such that a coupling loss is increased by a dielectric loss caused by the insulating layers 31*a* and 31*b*.

Further, since the conventional planar antenna is constructed by using the multilayer substrate 31, the structure is complicated and its fabrication method is accordingly complicated. Consequently, the price cannot be reduced.

SUMMARY OF THE INVENTION

It is therefore an object of the invention to provide a planar antenna which can realize separation of a vertical voltage and a horizontal voltage, synthesis of the vertical voltages, and synthesis of the horizontal voltages with little loss, yet at a low price.

According to the invention, in order to solve the problem, there is provided a planar antenna comprising: an insulating substrate; first, second, third, and fourth antenna elements arranged on the top face of the insulating substrate, each of which is formed by a square conductive layer whose one side is equal to the half of the wavelength of a receiving electric wave; first, second, third, and fourth transmission lines each having a length equal to or longer than the half of the wavelength, for connecting the first to fourth antenna elements in a ring shape; a fifth transmission line; and a sixth transmission line, wherein the first to fourth antenna elements are arranged in two rows and two columns in a state where one side of one of neighboring antenna elements faces one side of the other antenna element, the facing one sides are connected via each of the first to fourth transmission lines, the first and second transmission lines face each other, the third and fourth transmission lines face each other, the fifth transmission line is connected between a point in the first transmission line and a point in the second transmission line, at each of the points the difference between the length from the point to one side of the one antenna element and the length from the point to one side of the other antenna element is equal to the half of the wavelength, the sixth transmission line is connected between one point in the third transmission line and one point in the fourth transmission line, at each of the points the difference between the length from the point to one side of the one antenna element and the length from the point to one side of the other antenna element is equal to the half of the wavelength, a voltage based on a vertically polarized wave is outputted from an intermediate position of the fifth transmission line and a voltage based on a horizontally polarized wave is outputted from an intermediate position of the sixth transmission line.

In the planar antenna of the invention, each of a length between the one point in each of the first to fourth transmission lines and one side of one antenna element and a length between the one point and one side of the other antenna element is set to be three times or more of the thickness of the insulating substrate.

In the planar antenna of the invention, each of the first to fourth transmission lines is connected between the center position of one side of the one antenna element and the center position of one side of the other antenna element.

In the planar antenna of the invention, a part of or the whole fifth or sixth transmission line is provided on the under face of the insulating substrate.

In the planar antenna of the invention, an earth conductor is provided on the under face of the insulating substrate in correspondence to at least areas where the first to fourth antenna elements are arranged.

DETAILED DESCRIPTION OF THE PREFERRED EMBODIMENT

Figure 1:
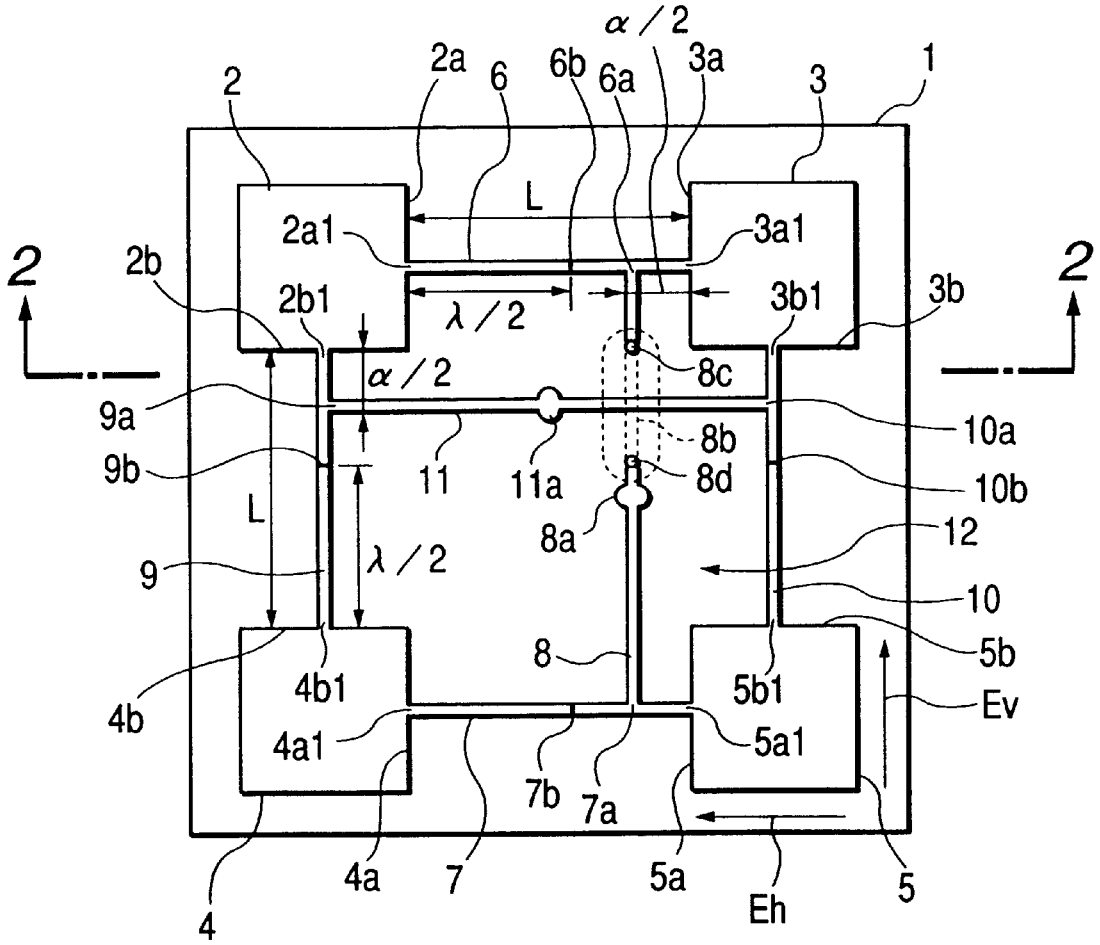
FIG. 1 is a top view of a planar antenna of the invention.
Figure 2:
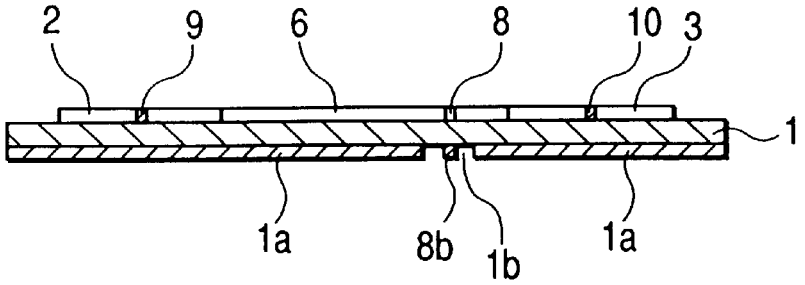
FIG. 2 is a cross section of the main part of FIG. 1.
Figure 3:
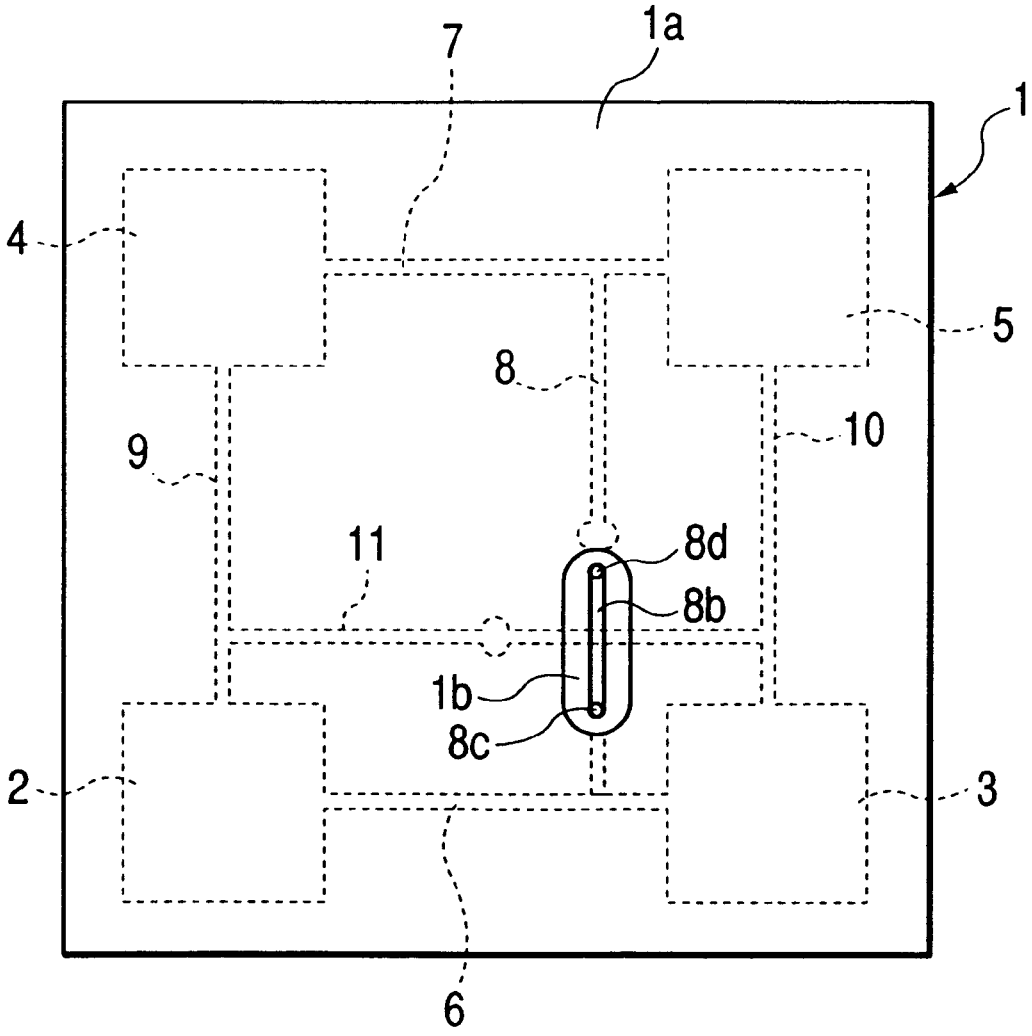
FIG. 3 is a bottom view of the planar antenna of the invention.
Figure 4:
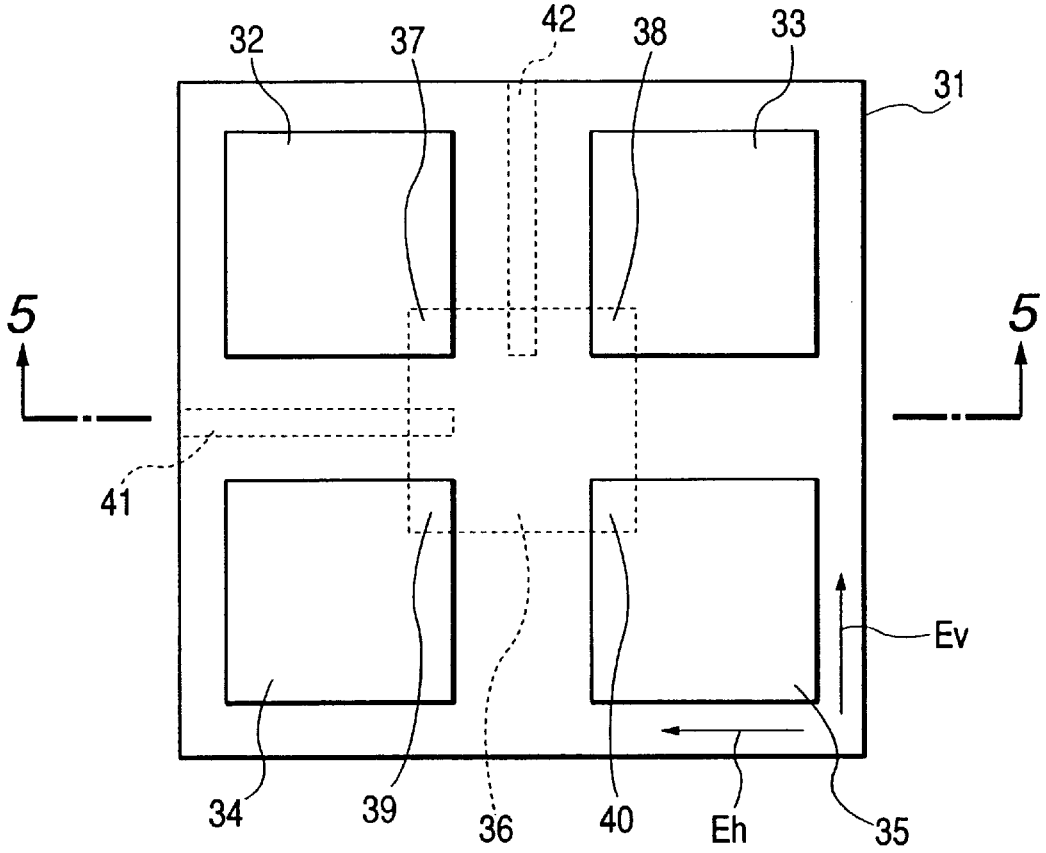
FIG. 4 PRIOR ART
FIG. 4 is a top view of a conventional planar antenna.
Figure 5:
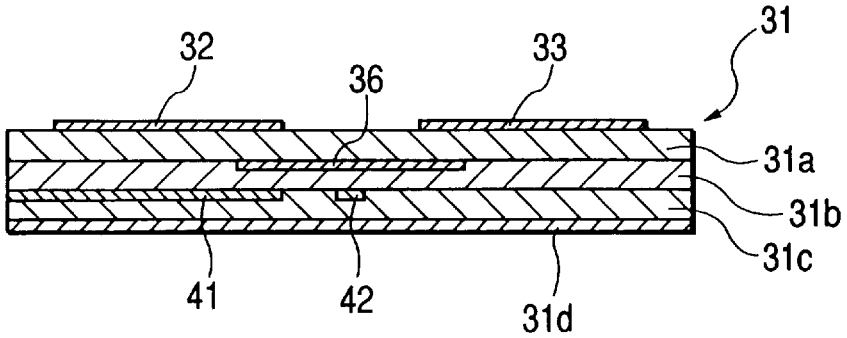
FIG. 5 PRIOR ART
FIG. 5 is a cross section of the main part of the conventional antenna.

A planar antenna of the invention will be described with reference to FIGS. 1 to 3. FIG. 1 is a top view, FIG. 2 is a cross section of the main part of FIG. 1, and FIG. 3 is a bottom view. First, on an insulating substrate 1, four antenna elements, that is, a first antenna element 2, a second antenna element 3, a third antenna element 4, and a fourth antenna element 5 are arranged in two rows and two columns and in the vertical and lateral directions which are different from each other by 90 degrees in a state where one sides of neighboring elements face each other in parallel. Each of the antenna elements 2, 3, 4, and 5 is formed by a conductive layer in a square shape by, for example, etching conductive foil on the insulating substrate 1. The length of one side is set so as to be equal to about the half of the wavelength of a receiving wave ($\lambda/2$). With this length, the resonance frequency of each of the antenna elements 2, 3, 4, and 5 coincides with the center frequency of the receiving wave. Here, $\lambda$ denotes a wavelength when the receiving wave is transferred in the insulating substrate 1. On the under face of the insulating substrate 1, an earth conductor 1*a* (refer to FIGS. 2 and 3) is formed on almost the whole face.

The antenna elements 2, 3, 4, and 5 are arranged so that an interval between facing antenna elements, for example, an interval (L) between one side 2*a* (called inner side) of the first antenna element 2 as one antenna element and one side 3*a* of the second antenna element 3 as the other antenna element is set to the half of the wavelength of a receiving wave ($L=\lambda/2+\alpha$) or larger. When the thickness of the insulating plate 1 is (t), it is preferable that $\alpha$ is equal to or larger than 6 t ($\alpha \cdot 6$ t). Each of the other intervals between facing antenna elements is similarly set so as to be (L).

Between facing two sides of neighboring elements of the antenna elements 2, 3, 4, and 5, as illustrated in FIG. 1, a voltage Ev in the vertical direction based on a vertically polarized wave (hereinbelow, referred to as a vertical voltage) and a voltage Eh in the lateral direction based on a horizontally polarized wave (hereinbelow, referred to as a horizontal voltage) are induced. In order to separate the vertical voltage Ev and the horizontal voltage Eh from each other, synthesize and take out the vertical voltages Ev, and synthesize and take out the horizontal voltages Eh, the antenna elements 2, 3, 4, and 5 are connected to each other.

First, the first and second antenna elements 2 and 3 in the first row which are arranged in the lateral direction are connected to each other via a first transmission line 6. Similarly, the third and fourth antenna elements 4 and 5 in the second row which are arranged in the lateral direction are connected to each other via a second transmission line 7.

Meanwhile, the first and third antenna elements 2 and 4 in the first column which are arranged in the vertical direction are connected to each other via a third transmission line 9. Similarly, the second and fourth antenna elements 3 and 5 in the second column which are connected in the vertical direction are connected to each other via a fourth transmission line 10.

The first and second transmission lines 6 and 7 therefore face each other and the third and fourth transmission lines 9 and 10 face each other. A fifth transmission line 8 is parallel to the third and fourth transmission lines 9 and 10. A sixth transmission line 11 is parallel to the first and second transmission lines 6 and 7.

First, the first and second transmission lines 6 and 7 are connected via the fifth transmission line 8, thereby synthesizing the horizontal voltages Eh induced by the antenna elements 2, 3, 4, and 5. For this purpose, intermediate points $2a_1$ and $3a_1$ of the facing inner sides 2*a* and 3*a* of the first and second antenna elements 2 and 3 are connected via the first transmission line 6. Similarly, intermediate points $4a_1$ and $5a_1$ of facing inner sides 4*a* and 5*a* of the third and fourth antenna elements 4 and 5 are connected via the second transmission line 7. The length L of each of the first and second transmission lines 6 and 7 is therefore equal to ($\alpha/2+\alpha$).

The horizontal voltage induced by the inner side 2*a* of the first antenna element 2 and that induced by the inner side 4*a* of the third antenna element 4 have the in-phase relation (hereinbelow, indicated by EH_). The horizontal voltage induced by the inner side 3*a* of the second antenna element 3 and that induced by the inner side 5*a* of the fourth antenna element 5 have the in-phase relation (hereinbelow, shown by $Eh_+$). The horizontal voltages EH_ and $Eh_+$ have, however, the opposite-phase relation. The connecting positions of the fifth transmission line 8 to the first transmission line 6 and the second transmission line 7 are determined so that the voltages are synthesized in-phase.

Specifically, a position 6*a* on the first transmission line 6 apart from the inner side 3*a* of the second antenna element 3 only by a distance of $\alpha/2$ (consequently, $\alpha/2 \cdot 3$ t) and a position 7*a* on the second transmission line 7 apart from the inner side 5*a* of the fourth antenna element 5 only by a distance of $\alpha/2$ are connected via the fifth transmission line 8.

Consequently, first, in a position 6*b* on the first transmission line 6 which is apart from the inner side 2*a* of the first antenna element 2 only by $\lambda/2$, the horizontal voltage Eh− at the inner side 2*a* appears as Eh+ by a phase rotation of 180 degrees and comes to have the same phase as that of the horizontal voltage Eh+ at the inner side 3*a* of the second antenna element 3.

Meanwhile, in a position 7*b* on the second transmission line 7 which is apart from the inner side 4*a* of the third antenna element 4 only by $\lambda/2$, the horizontal voltage Eh− at the inner side 4*a* appears as Eh+ by a phase rotation of 180 degrees and comes to have the same phase as that of the horizontal voltage Eh+ at the inner side 5*a* of the fourth antenna element 5.

From an intermediate point 8*a* of the fifth transmission line 8 connecting the position 6*a* as an intermediate point between the position 6*b* on the first transmission line 6 and the inner side 3*a* of the second antenna element 3 and the position 7*a* as an intermediate point between the position 7*b* on the second transmission line 7 and the inner side 5*a* of the fourth antenna element 5, the horizontal voltages Eh induced by the antenna elements 2, 3, 4, and 5 are synthesized in-phase.

The third transmission line 9 and the fourth transmission line 10 are connected via the sixth transmission line 11, thereby synthesizing the vertical voltages Ev induced by the antenna elements 2, 3, 4, and 5. For this purpose, first, intermediate points $2b_1$ and $4b_1$ of facing inner sides 2*b* and 4*b* of the first and third antenna elements 2 and 4 are connected via the third transmission line 9. Similarly, intermediate points $3b_1$ and $5b_1$ of facing inner sides 3*b* and 5*b* of the second and fourth antenna elements 3 and 5 are connected via the fourth transmission line 10. The length (L) of each of the third and fourth transmission lines 9 and 10 is therefore equal to $(\lambda/2+\alpha)$.

In this case, the vertical voltage induced by the inner side 2*b* of the first antenna element 2 and the vertical voltage induced by the inner side 3*b* of the second antenna element 3 have the in-phase relation (hereinbelow, expressed as Ev_). The vertical voltage induced by the inner side 4*b* of the third antenna element 4 and the vertical voltage induced by the inner side 5*b* of the fourth antenna element 5 have the in-phase relation (hereinbelow, expressed as $Ev_+$). The vertical voltages Ev_ and $Ev_+$, however, have an opposite-phase relation. The connecting positions of the sixth transmission line 11 and the third and fourth transmission lines 9 and 10 are determined so that the phases of the vertical voltages Ev_ and $Ev_+$ are synthesized to have the same phase.

Specifically, a position 9*a* on the third transmission line 9 apart from the inner side 2*b* of the first antenna element 2 only by a distance of $\alpha/2$ and a position 10*a* on the fourth transmission line 10 apart from the inner side 3*b* of the second antenna element 3 only by a distance of $\alpha/2$ are connected via the sixth transmission line 11.

In this manner, first, in the position 9*b* on the third transmission line 9 which is apart from the inner side 4*b* of the third antenna element 4 only by $\lambda/2$, the vertical voltage $Ev_+$ at the inner side 4*b* appears as Ev_ by a phase rotation of 180 degrees and comes to have the same phase as that of the vertical voltage Ev_ at the inner side 2*b* of the first antenna element 2.

Meanwhile, similarly, in a position 10*b* on the fourth transmission line 10 which is apart from the inner side 5*b* of the fourth antenna element 5 only by $\lambda/2$, the vertical voltage $Ev_+$ at the inner side 5*b* appears as Ev_ by a phase rotation of 180 degrees and comes to have the same phase as that of the vertical voltage Ev_ at the inner side 3*b* of the second antenna element 3.

From the intermediate point 11*b* of the sixth transmission line 11 connecting the position 9*a* as an intermediate point between the position 9*b* on the third transmission line 9 and the inner side 2*b* of the first antenna element 2 and the position 10*a* as an intermediate point between the position 10*b* on the fourth transmission line 10 and the inner side 3*b* of the second antenna element 3, the vertical voltages Ev induced by the antenna elements 2, 3, 4, and 5 are therefore synthesized in-phase.

The fifth transmission line 8 is connected to both of the first and second transmission lines 6 and 7 in positions apart from the inner side 3*a* of the second antenna element 3 and the inner side 5*a* of the fourth antenna element 5, respectively, only by $\alpha/2$. This distance corresponds to a distance which is three times of the thickness (t) of the insulating substrate 1. An influence by the electric fields on the inner sides 3*a* and 5*a* is therefore eliminated, so that the accurate horizontal voltages can be synthesized. Similarly, the sixth transmission line 11 is connected to both of the third and fourth transmission lines 9 and 10 in positions apart from the inner side 2*b* of the first antenna element 2 and the inner side 3*b* of the second antenna element 3, respectively, only by $\alpha/2$. Similarly, the distance corresponds to a distance which is three times of the thickness (t) of the insulating substrate 1. The influence by the electric fields on the inner sides 2*b* and 3*b* is consequently eliminated, so that the accurate vertical voltages can be synthesized.

As described above, the first to fourth transmission lines 6, 7, 9, and 10 directly mutually connecting the antenna elements 2, 3, 4, and 5, the fifth transmission line 8 connecting the first and second transmission lines 6 and 7, and the sixth transmission line 11 connecting the third and fourth transmission lines 9 and 10 construct a synthesizing circuit 12 for synthesizing the vertical voltages and horizontal voltages, respectively, induced by the antenna elements 2, 3, 4, and 5. By setting the length (L) of each of the first to fourth transmission lines 6, 7, 9, and 10 to $(\lambda/2+\alpha)$, each of the transmission lines can be made the shortest and the fifth transmission line 8 connecting the first and second transmission lines 6 and 7 and the sixth transmission line 11 connecting the third and fourth transmission lines 9 and 10 can be made the shortest. The transmission loss in the synthesizing circuit 12 can be therefore minimized. Thus, by using the planar antenna of the invention, a satellite broadcasting receiver having excellent NF (noise figure) can be constructed.

Moreover, in the invention, the planar antenna can be easily constructed by using a double-sided printed board having conductive foil on both faces without using a multilayered substrate. A satellite broadcasting receiver can be therefore constructed at a low price.

Since the fifth transmission line 8 and the sixth transmission line 11 cross each other, in order to avoid the contact of the lines, for example, a part 8*b* of the fifth transmission line 8 as one of the transmission lines is provided on the under face of the insulating substrate 1 and is connected via through holes 8*c* and 8*d*. In this case, it is sufficient to provide a conductor eliminated part 1*b* from which the earth conductor la is eliminated, around the part 8*b*. The whole fifth transmission line 8 may be provided on the under face of the insulating substrate 1.

As described above, in the planar antenna of the invention, the first to fourth antenna elements are arranged in two rows and two columns in a state where one side of one of neighboring antenna elements faces one side of the other antenna element, the facing one sides are connected via each of the first to fourth transmission lines, the first and second transmission lines face each other, the third and fourth transmission lines face each other, the fifth transmission line is connected between one point in the first transmission line and one point in the second transmission line, at each of the points the difference between the length from the point to one side of one antenna element and the length from the point to one side of the other antenna element is equal to the half of the wavelength, the sixth transmission line is connected between one point in the third transmission line and one point in the fourth transmission line, at each of the points the difference between the length from the point to one side of one antenna element and the length from the point to one side of the other antenna element is equal to the half of the wavelength, a voltage based on a vertically polarized wave is outputted from an intermediate point of the fifth transmission line and a voltage based on a horizontally polarized wave is outputted from an intermediate point of the sixth transmission line. Consequently, the length of each of the first to fourth transmission lines can be made the shortest. Further, each of the fifth transmission line and the sixth transmission line can be made the shortest. As a result, the transmission loss in the synthesizing circuit can be minimized. By using the planar antenna of the invention, therefore, the satellite broadcasting receiver having excellent NF (noise figure) can be constructed.

In the planar antenna of the invention, each of a length between the one point in each of the first to fourth transmission lines and one side of one antenna element and a length between the one point and one side of the other antenna element is set to be three times or more as long as the thickness of the insulating substrate. Consequently, the influence of the electric field on one side of the antenna element is eliminated, so that the voltages based on the horizontally polarized wave and the voltages based on the vertically polarized wave can be respectively synthesized with high accuracy.

According to the planar antenna of the invention, each of the first to fourth transmission lines is connected between the center position of one side of one antenna element and the center position of one side of the other antenna element. Consequently, the voltages based on the horizontally polarized wave and the voltages based on the vertically polarized wave can be respectively synthesized without influencing each other.

According to the planar antenna of the invention, a part of or the whole fifth or sixth transmission line is provided on the under face of the insulating substrate. Each of the fifth and sixth transmission lines can be made the shortest while avoiding the contact between the lines.

According to the planar antenna of the invention, an earth conductor is provided on the under face of the insulating substrate in correspondence to at least areas where the first to fourth antenna elements are arranged. By using a printed board having conductive foil on both faces, the planar antenna can be easily constructed.

What is claimed is:

1. A planar antenna comprising:

an insulating substrate;

first, second, third, and fourth antenna elements arranged on the top face of the insulating substrate, each of which is formed by a square conductive layer whose one side is equal to the half of the wavelength of a receiving electric wave;

first, second, third, and fourth transmission lines each having a length equal to or longer than the half of the wavelength, for connecting the first to fourth antenna elements in a ring shape;

a fifth transmission line; and a sixth transmission line, wherein the first to fourth antenna elements are arranged in two rows and two columns in a state where one side of one of neighboring antenna elements faces one side of the other antenna element, the facing one sides are connected via each of the first to fourth transmission lines, the first and second transmission lines face each other, the third and fourth transmission lines face each other, the fifth transmission line is connected between a point in the first transmission line and a point in the second transmission line, at each of the points the difference between the length from the point to one side of the one antenna element and the length from the point to one side of the other antenna element is equal to the half of the wavelength, the sixth transmission line is connected between a point in the third transmission line and a point in the fourth transmission line, at each of the points the difference between the length from the point to one side of the one antenna element and the length from the point to one side of the other antenna element is equal to the half of the wavelength, a voltage based on a vertically polarized wave is outputted from an intermediate position of the fifth transmission line and a voltage based on a horizontally polarized wave is outputted from an intermediate position of the sixth transmission line.

2. A planar antenna according to claim 1, wherein each of a length between the one point in each of the first to fourth transmission lines and one side of the one antenna element and a length between the one point and one side of the other antenna element is set to be three times of the thickness of the insulating substrate or more.

3. A planar antenna according to claim 2, wherein each of the first to fourth transmission lines is connected between the center position of one side of the one antenna element and the center position of one side of the other antenna element.

4. A planar antenna according to claim 1, wherein a part of or the whole fifth or sixth transmission line is provided on the under face of the insulating substrate.

5. A planar antenna according to claim 1, wherein an earth conductor is provided on the under face of the insulating substrate in correspondence to at least areas where the first to fourth antenna elements are arranged.

* * * * *